US005712454A

United States Patent [19]

Ozawa et al.

[11] Patent Number: 5,712,454

[45] Date of Patent: Jan. 27, 1998

[54] EXHAUST SYSTEM IN INTERNAL COMBUSTION ENGINE

[75] Inventors: Hidenori Ozawa; Kazuhiro Tsuda, both of Wako; Isao Hirokawa, Kitsuregawa-machi; Katsunori Muramatsu, Kitsuregawa-machi; Ryoichi Matsushima, Kitsuregawa-machi, all of Japan

[73] Assignees: Honda Giken Kogyo Kabushiki Kaisha, Tokyo; Yutaka Giken Co., Ltd., Shizuoka, both of Japan

[21] Appl. No.: 592,523

[22] Filed: Jan. 26, 1996

[30] Foreign Application Priority Data

Jan. 27, 1995 [JP] Japan ..... 7-011416
Jan. 27, 1995 [JP] Japan ..... 7-011417
Jan. 27, 1995 [JP] Japan ..... 7-011418

[51] Int. Cl.[6] ..... F01N 1/08

[52] U.S. Cl. ..... 181/226; 181/254; 181/265; 181/272; 181/282

[58] Field of Search ..... 181/228, 237, 181/239, 264, 265, 266, 269, 272, 282, 226, 254

[56] References Cited

U.S. PATENT DOCUMENTS 3,620,330 11/1971 Hall ..... 181/266
4,484,659 11/1984 Buchwalder ..... 181/266
4,699,244 10/1987 Bergquist et al. ..... 181/226
4,971,166 11/1990 Hase ..... 181/254
5,614,699 3/1997 Yashiro et al. ..... 181/254

FOREIGN PATENT DOCUMENTS 6-221130 8/1994 Japan .

*Primary Examiner*—Khanh Dang
*Attorney, Agent, or Firm*—Nikaido, Marmelstein, Murray & Oram LLP

[57] ABSTRACT

An exhaust system in an internal combustion engine includes a flow rate regulating valve which is positioned in an intermediate portion of an exhaust gas flow passage. The flow rate regulating valve has a rotary shaft rotatably supported in a valve housing, and a rotationally biasing spring mounted between the rotary shaft and the valve housing which provides a spring force to rotationally bias the rotary shaft. In the exhaust system, an axially biasing spring is mounted separately from the rotationally biasing spring between the valve housing and the rotary shaft for biasing the rotary shaft in an axial direction. The rotary shaft is provided with an abutment surface which faces in the one axial direction, and the valve housing is provided with a limiting portion which abuts against the abutment surface to limit the axial movement of the rotary shaft. Thus, the rotary shaft is biased in the one axial direction by the axially biasing spring, and the abutment surface of the rotary shaft is urged against the limiting portion of the valve housing, thereby avoiding the axially chattering of the rotary shaft.

5 Claims, 8 Drawing Sheets

EXHAUST SYSTEM IN INTERNAL COMBUSTION ENGINE

BACKGROUND OF THE INVENTION

1. Field of the Invention

The present invention relates to an exhaust system in an internal combustion engine. The exhaust system includes a flow rate regulating valve which is disposed in an intermediate portion of an exhaust gas flow passage and which has a rotary shaft rotatably supported in a valve housing, a valve member secured to the rotary shaft, and a rotationally biasing spring which is mounted between the rotary shaft and the valve housing to provide a spring force for rotationally biasing the rotary shaft.

2. Description of the Prior Art

Japanese Patent Application Laid-Open No. 221130/94 describes a conventional exhaust system.

In such a system, in order to ensure a smooth rotating operation of the flow rate regulating valve, a small gap must be provided between a valve member and the valve housing. For this reason, in the above known system, the rotary shaft chatters axially, and the generation of noise caused by the chattering cannot be avoided.

In addition, in the above known system, the valve member is accommodated in the valve housing disposed within the shell of a silencer and is biased in a direction to increase the flow resistance, by a rotationally biasing spring. However, the rotationally biasing spring is exposed to the outside of the shell of the silencer and hence, the rotationally biasing spring may become rusted, or may be damaged by a small flying stone during the traveling of a vehicle. Moreover, a movable member connected to the valve member may protrude to the outside of the shell and hence, there is a possibility that the gas may leak out of the shell.

Further, in the above known system, a pipe-like valve housing is mounted to the outlet side of a inner pipe which interconnects two of a plurality of silencing chambers which are defined in the shell of the silencer. A butterfly-shaped valve member rotatably accommodated in the valve housing, is subjected to an exhaust gas pressure in a direction to decrease the flow resistance and is biased in a direction to increase the flow resistance. For this reason, if the operating position of the valve member, i.e., the rotational angle thereof is determined, only a single value of the flow resistance is determined, and the degree of freedom for setting of the flow rate with respect to the exhaust gas pressure is relatively small.

SUMMARY OF THE INVENTION

It is a first object of the present invention to avoid the axial chattering of the rotary shaft of the flow rate regulating valve to prevent the generation of a noise.

To achieve the above object, according to a first aspect and feature of the present invention, there is provided an exhaust system in an internal combustion engine, comprising a flow rate regulating valve which is disposed in an intermediate portion of an exhaust gas flow passage and which has a rotary shaft rotatably supported in a valve housing; a valve member secured to the rotary shaft; and a rotationally biasing spring mounted between the rotary shaft and the valve housing to exhibit a spring force for rotationally biasing the rotary shaft. The system further includes an axially biasing spring which is mounted separately from the rotationally biasing spring between the valve housing and the rotary shaft for biasing the rotary shaft in one axial direction, the rotary shaft being provided with an abutment surface which faces in the one axial direction, and the valve housing being provided with a limiting portion which abuts against the abutment surface to limit an axial movement of the rotary shaft.

With the first feature of the present invention, the rotary shaft of the flow rate regulating valve is biased in the one axial direction by the axially biasing spring, such that the abutment surface of the rotary shaft is urged against the limiting portion of the valve housing, thereby avoiding the axial chattering of the rotary shaft.

It is a second object of the present invention to prevent the rusting and external damage to the rotationally biasing spring and also to prevent the leaking of the gas out of the shell.

According to a second aspect and feature of the present invention, there is provided an exhaust system in an internal combustion engine, comprising a flow rate regulating valve comprised of a valve member which is operatively accommodated within a valve housing disposed within a shell of a silencer and which is biased by a spring in a direction to increase flow resistance. The system further includes a spring chamber which is formed between a case member secured to the shell and connected to the valve housing and the shell or a cover fixedly mounted to the shell to face the outside, the spring chamber being isolated from the inside of the shell and the valve housing and also isolated from the outside of the shell. A rotationally biasing spring is positioned in the spring chamber for biasing the valve member in a direction to increase the flow resistance.

With the second feature of the present invention, the rotationally biasing spring is exposed to the outside of the shell and thus, it is possible to prevent the rusting and external damage of the rotationally biasing spring. Moreover, it is possible to reliably prevent the gas in the shell from being leaked to the outside, and to prevent the rotationally biasing spring from suffering thermal damage by the fact that the cover or the shell itself is cooled by the open air and hence, the inside of the spring chamber cannot be over-heated.

Further, it is a third object of the present invention to enable the flow resistance of the flow rate regulating valve to the exhaust gas pressure to be set relatively freely.

To achieve the above object, according to a third aspect and feature of the present invention, there is provided an exhaust system in an internal combustion engine, comprising a flow rate regulating valve comprised of a valve member which is operatively positioned within a valve housing and which is subjected to an exhaust gas pressure in a direction to decrease the flow resistance and biased by a spring in a direction to increase the flow resistance. The flow rate regulating valve is mounted to an outlet side of an inner pipe which interconnects two of a plurality of silencing chambers formed within the shell of a silencer. The valve member forms a flow-in chamber between the valve member and the valve housing and has an outer edge which is in proximity to and opposed to an inner surface of the valve housing, the valve member being positioned within the valve housing for movement between a position to minimize a volume of the flow-in chamber and a position to maximize the volume of the flow-in chamber. The valve housing includes an inlet pipe which is connected to the inner pipe and protrudes into the flow-in chamber, and is provided at an inner end thereof with an opening which is opposed to the valve member, and an outlet window, whose area facing the flow-in chamber is increased as the valve member is operated from a communication start point established in an operational range of the valve member in a direction to increase a volume of the flow-in chamber.

With the third feature of the present invention, while the valve member is moved from the position to minimize the volume of the flow-in chamber to the communication start point, an exhaust gas flowing out of the inner pipe via the inlet pipe into the flow-in chamber flows via the gap provided between the inner surface of the valve housing and the outer edge of the valve member into the outlet window. While the valve member is moved from the communication start point to the position to maximize the volume of the flow-in chamber, the exhaust gas flows from the flow-in chamber directly into the outlet window. Thus, it is possible to set the flow resistance, i.e., the flow rate corresponding to the operated position of the valve member at any value, depending upon the determination of the communication start point at a position within the operational range of the valve member and depending upon the determination of the shape of the outlet window.

The above and other objects, features and advantages of the invention will become apparent from the following description of a preferred embodiment taken in conjunction with the accompanying drawings.

DESCRIPTION OF THE PREFERRED EMBODIMENT

Figure 1:
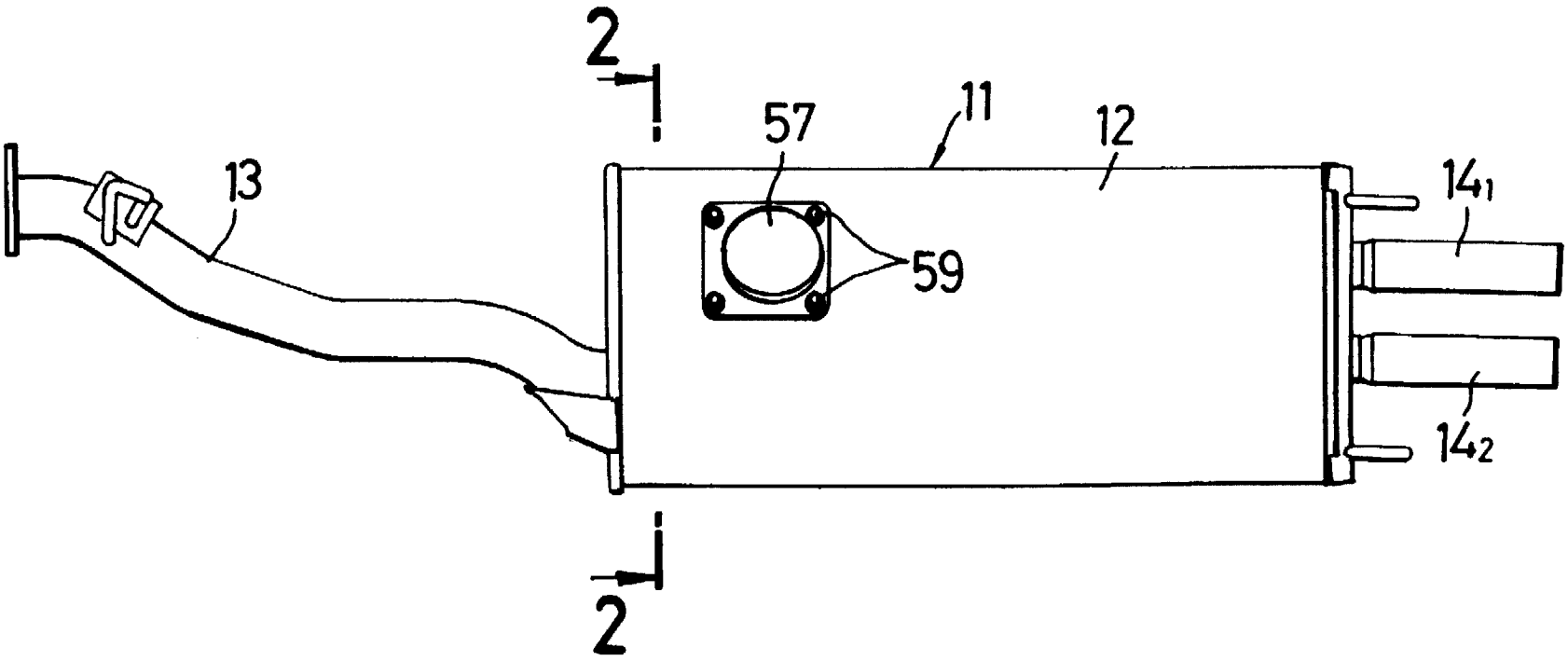
FIG. 1 is a plan view of a silencer, to which an embodiment of the present invention is applied.
Figure 2:
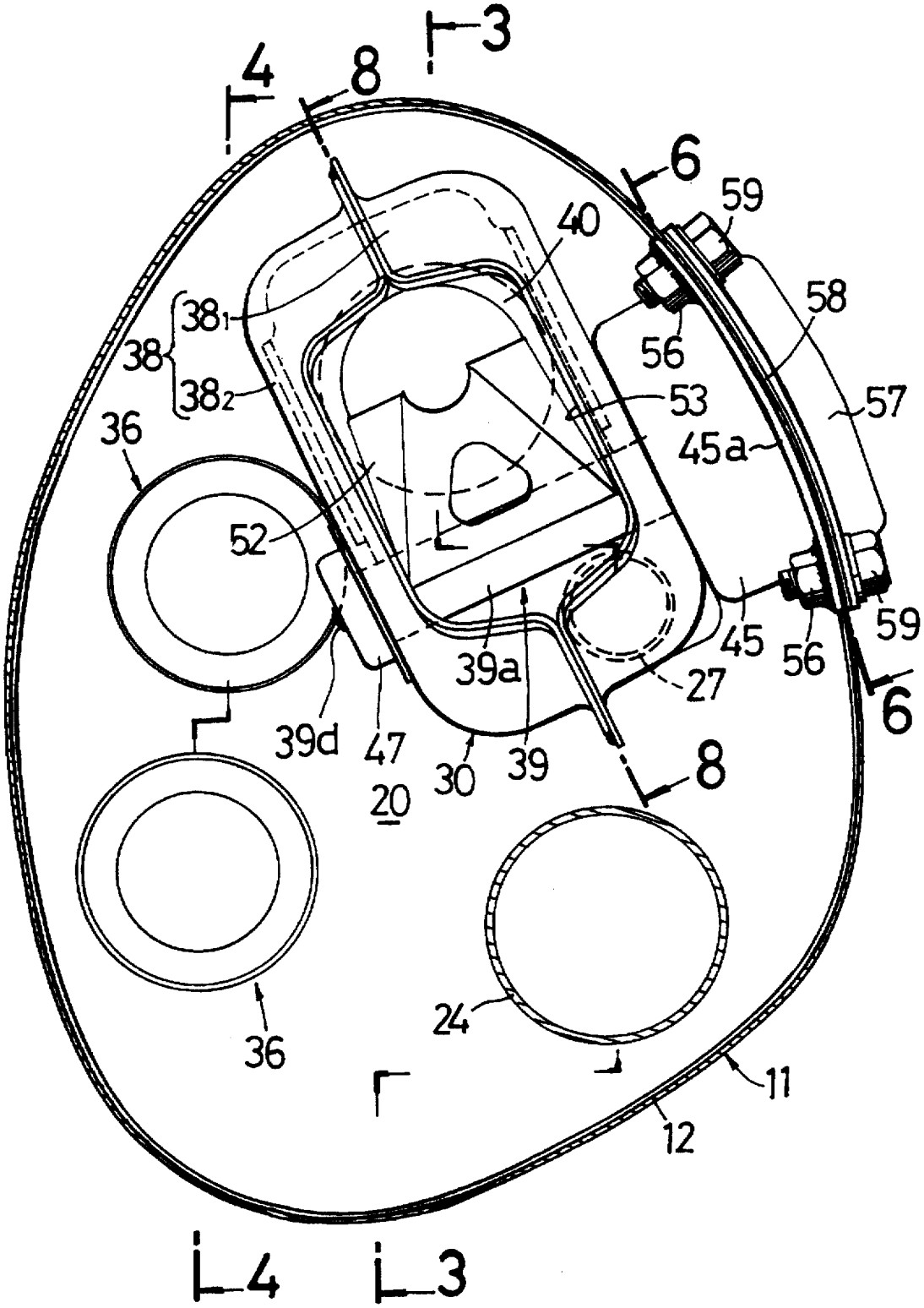
FIG. 2 is an enlarged sectional view taken along a line 2—2 in FIG. 1.
Figure 3:
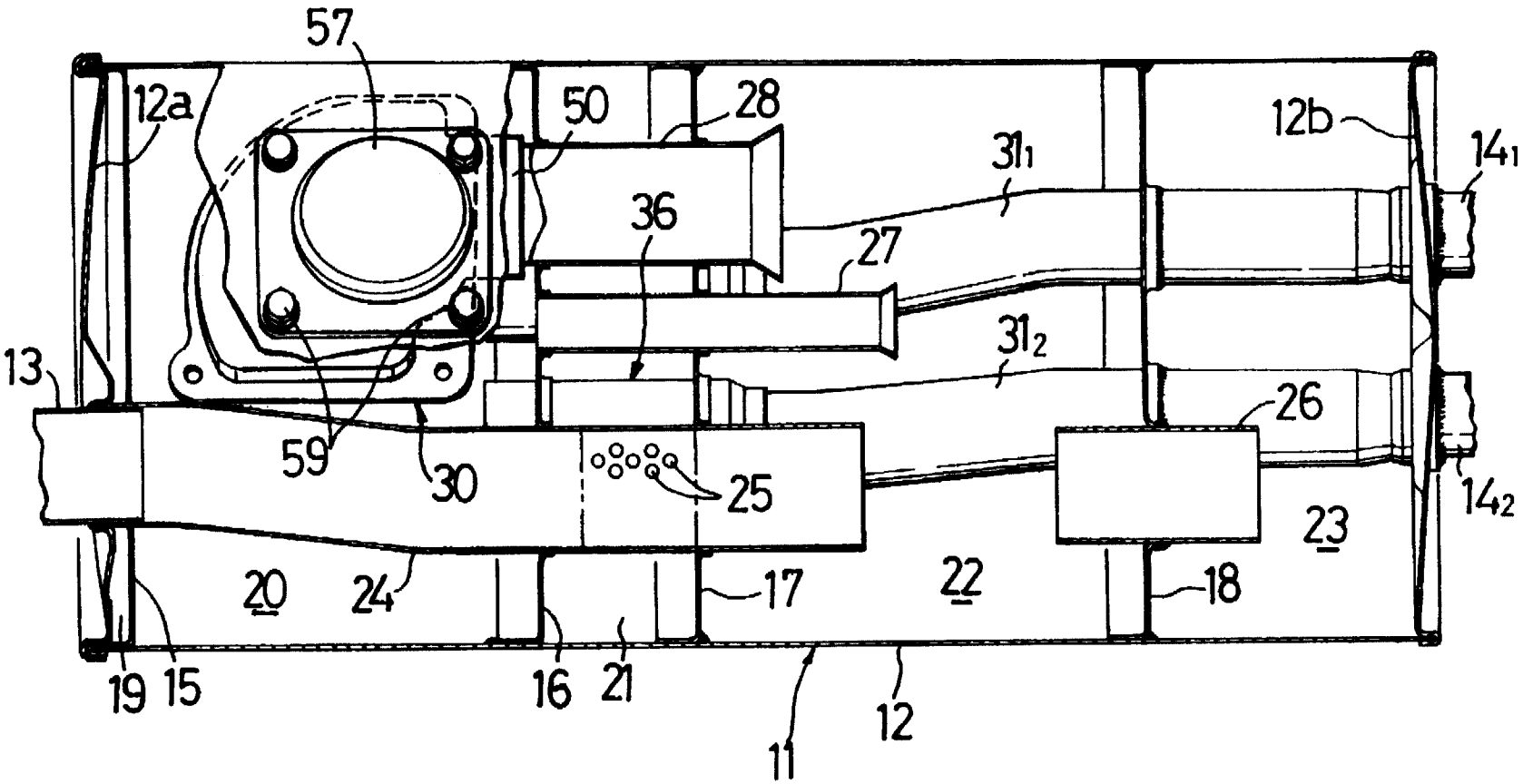
FIG. 3 is a vertical sectional view of the silencer, taken along a line 3—3 in FIG. 2.
Figure 4:
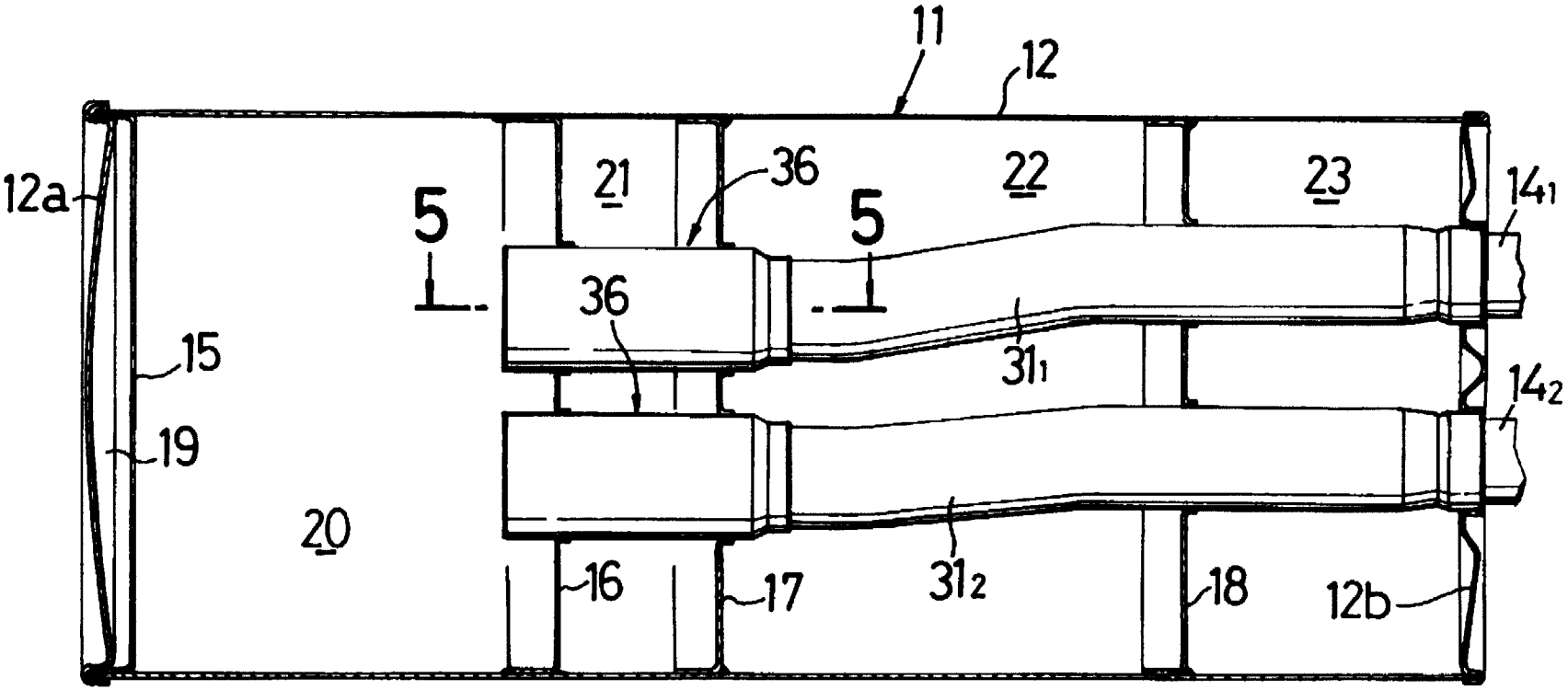
FIG. 4 is a vertical sectional view of the silencer, taken along a line 4—4 in FIG. 2.

Referring first to FIGS. 1 to 4, a shell 12 of a silencer 11 incorporated in an intermediate portion of an exhaust system of an internal combustion engine is formed into a cylindrical shape. A single exhaust gas input pipe 13 for introducing an exhaust gas from an engine body (not shown) is connected to one end wall 12*a* of the shell 12, and a pair of exhaust discharging pipes $14_1$ and $14_2$ are connected in parallel to each other to the other end wall 12*b* of the shell 12.

First, second, third and fourth partition walls 15, 16, 17 and 18 are fixedly disposed within the shell 12 at spaced-apart locations in sequence from one end wall 12*a* toward the other end wall 12*b*, in such a manner that their outer edges are welded to an inner peripheral surface of the shell 12. Thus, five silencing chambers are defined within the shell 12; a first silencing chamber 19 located between the one end wall 12*a* and the first partition wall 15; a second silencing chamber 20 located between the first and second partition walls 15 and 16; a third silencing chamber 21 located between the second and third partition walls 16 and 17; a fourth silencing chamber 22 located between the third and fourth partition walls 17 and 18; and a fifth silencing chamber 23 located between the fourth partition wall 18 and the other end wall 12*b*. The first partition wall 15 is disposed relatively in proximity to the one end wall 12*a* of the shell 12, and has a large number of small bores (not shown) provided uniformly over its entire surface.

A first inner pipe 24 extends through the first, second and third partition walls 15, 16 and 17 and is connected at its one end to the exhaust gas input pipe 13. The other end of the first inner pipe 24 opens into the fourth silencing chamber 22. Moreover, a large number of through-holes 25 are provided in a peripheral wall of the first inner pipe 24 at a section corresponding to the third silencing chamber 21. A second inner pipe 26 is disposed between the fourth and fifth silencing chambers 22 and 23 to extend through the fourth partition wall 18, with one end of the second inner pipe 26 being spaced apart from and opposed to an opening at the other end of the first inner pipe 24 within the fourth silencing chamber 22.

A third inner pipe 27 having a relatively small diameter and a fourth inner pipe 28 having a relatively large diameter are provided in parallel between the fourth silencing chamber 22 and the second silencing chamber 20. A flow rate regulating valve 30 is mounted at an end of the fourth inner pipe 28 within the second silencing chamber 20 for regulating the flow rate of the exhaust gas in an exhaust gas passage which extends from the fourth inner pipe 28 to the second silencing chamber 20. The flow rate regulating valve 30 is capable of varying the flow resistance in accordance with the pressure of the exhaust gas, such that when the pressure of the exhaust gas is relatively low in a low-speed revolution state of the internal combustion engine, the flow resistance is increased to constrict the flow rate of the exhaust gas, thereby reducing the exhaust gas noise, and when the pressure of the exhaust gas is relatively high in a high-speed revolution state of the internal combustion engine, the flow resistance is decreased to increase the flow rate of the exhaust gas, thereby increasing the output by a reduction in exhaust gas resistance.

Further, a pair of fifth inner pipes $31_1$ and $31_2$ are positioned in parallel to extend through the second, third and fourth partition walls 16, 17 and 18. One end of each of the fifth inner pipes $31_1$ and $31_2$ opens into the second silencing chamber 20. The other ends of the fifth inner pipes $31_1$ and $31_2$ are secured to the other end wall of the shell 12. The exhaust gas discharging pipes $14_1$ and $14_2$ are connected to the other ends of the fifth inner pipes $31_1$ and $31_2$, respectively.

Figure 5:
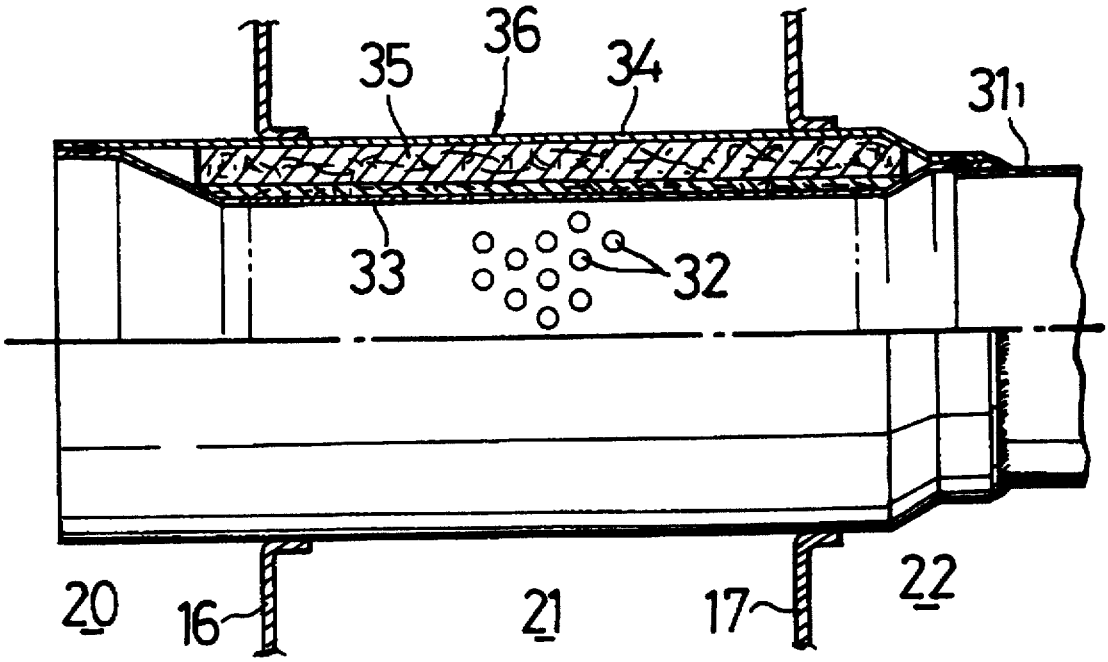
FIG. 5 is an enlarged sectional view taken along a line 5—5 in FIG. 4.

Moreover, sound-absorbing portions 36 are provided at one end of the fifth inner pipes $31_1$ and $31_2$ and each includes a sound-absorbing material 35 filled between an inner pipe portion 33 having a large number of through-holes 32 and an outer pipe portion 34 which coaxially surrounds the inner pipe portion 33, as shown in FIG. 5.

Figure 6:
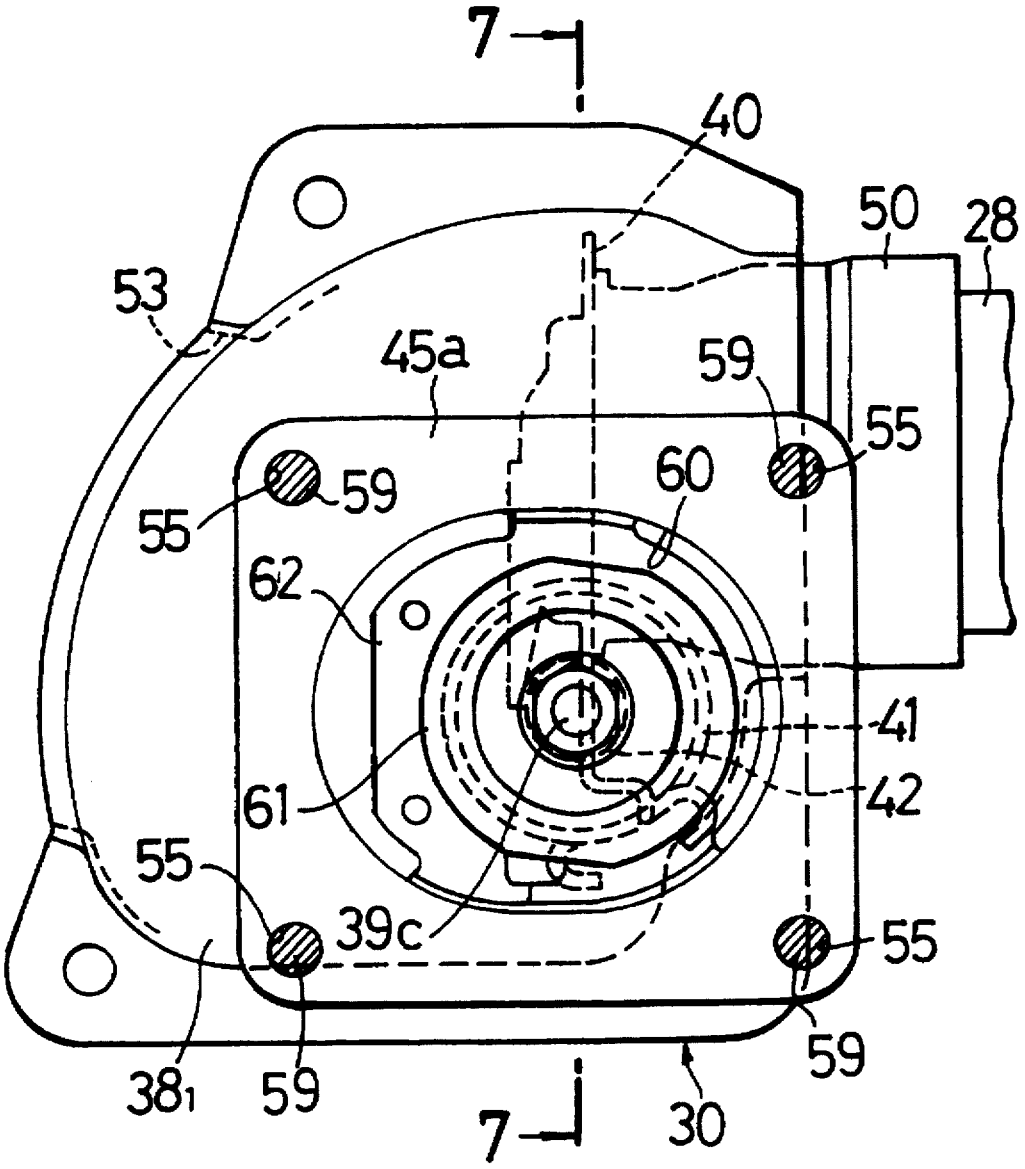
FIG. 6 is a sectional view taken along a line 6—6 in FIG. 2.
Figure 7:
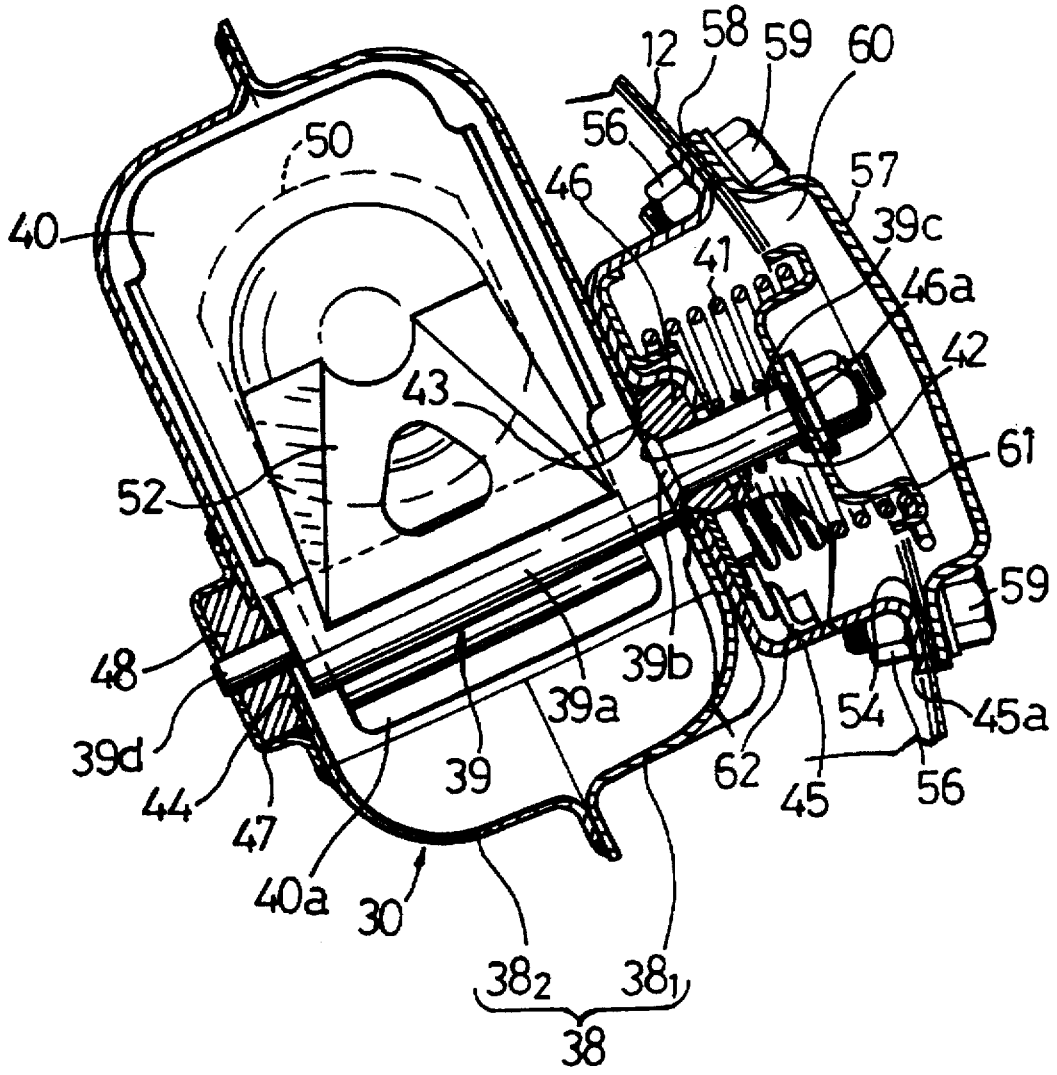
FIG. 7 is a sectional view taken along a line 7—7 in FIG. 6.
Figure 8:
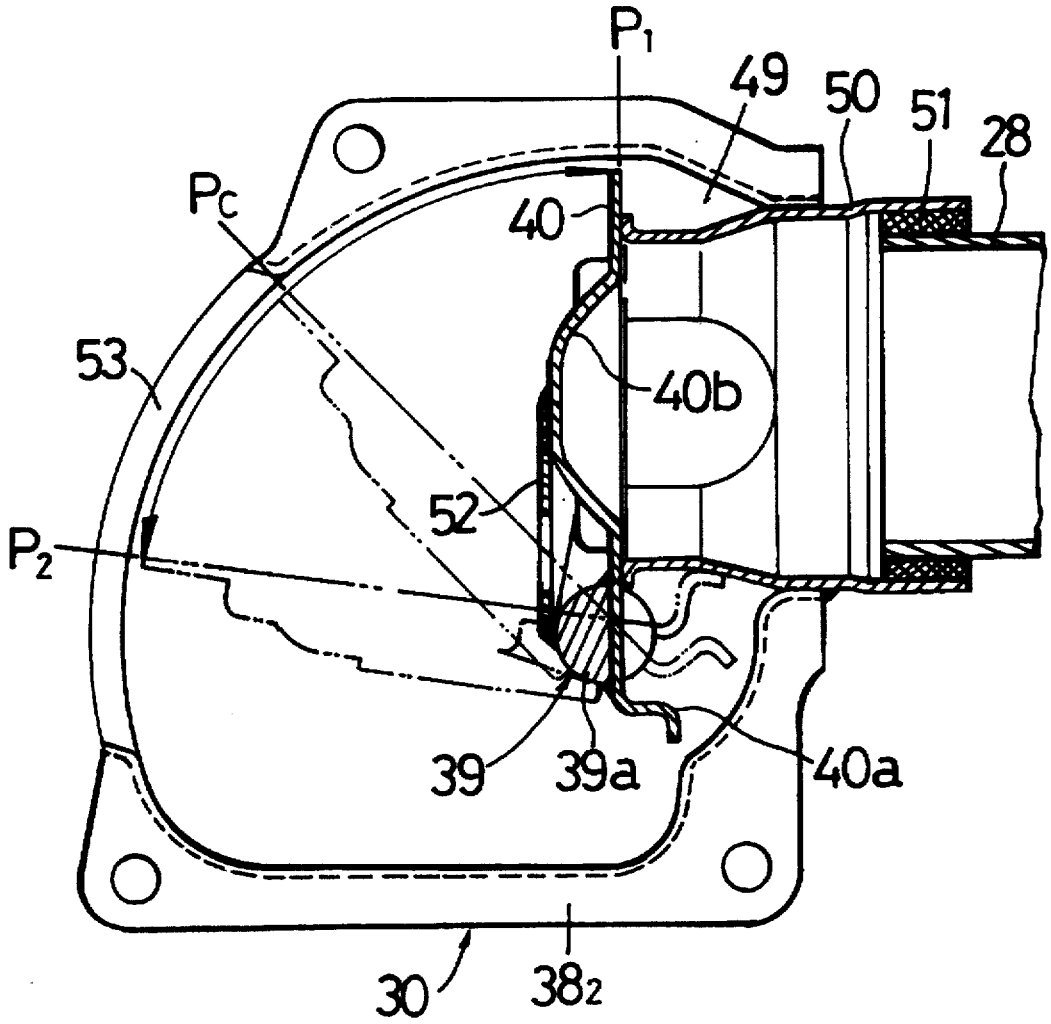
FIG. 8 is a sectional view taken along a line 8—8 in FIG. 2.

Referring also to FIGS. 6, 7 and 8, the flow rate regulating valve 30 includes a valve housing 38, a rotary shaft 39 which is rotatably carried in the valve housing 38, a valve member 40 which is accommodated within the valve housing 38 and secured to the rotary shaft 39, a rotationally biasing spring 41 for biasing the rotary shaft 39 in one of directions about its axis, and an axially biasing spring 42 for biasing the rotary shaft 39 in one axial direction. The flow rate regulating valve 30 is fixedly supported by the shell 12 of the silencer 11.

The valve housing 38 is formed into a hollow box-like configuration and includes first and second housing halves 381 and 382 which are formed into a dish-like configuration and welded and coupled to each other at their opened ends. Moreover, support bores 43 and 44 are coaxially provided in the housing halves $38_1$ and $38_2$ at mutually corresponding locations. A case member 45 in the form of a dish which opens toward the shell 12 is secured to an outer surface of the first housing half $38_1$ by welding. A metal bearing 46 is clamped between the case member 45 and the first housing half $38_1$, and faces the support bore 43. A support member 47 in the form of a dish which opens toward the second housing half $38_2$ is welded to an outer surface of the second housing half $38_2$. A metal bearing 48 is clamped between the support member 47 and the second housing half $38_2$, and faces the support bore 44.

The rotary shaft 39 is rotatably carried by the metal bearings 46 and 48, and includes a large-diameter shaft portion **39*a* which is located in the valve housing 38, a small-diameter shaft portion 39*c* which is coaxially connected to one end of the large-diameter shaft portion 39*a* through an abutment surface 39*b* which is formed into a tapered portion, and a small-diameter shaft portion 39*d* which is coaxially connected to the other end of the large-diameter shaft portion 39*a*. The small-diameter shaft portion 39*c* passes through the metal bearing 46 for gliding movement about the axis. Moreover, the metal bearing 46 is provided with a tapered limiting portion 46*a* which abuts against the tapered abutment surface 39*b* of the rotary shaft 93 for limiting the movement of the rotary shaft 39** in the axially one direction.

The valve member 40 is positioned in the valve housing 38 with its outer edge being in proximity to and opposed to the inner surface of the valve housing 38, and is secured to the large-diameter shaft portion **39*a* of the rotary shaft 39, such that a flow-in chamber 49 is defined between the valve member 40 and the inner surface of the valve housing 38. An inlet pipe 50 is fixedly mounted to the valve housing 38, such that an opening at an inner end of the inlet pipe 50 protrudes into the flow-in chamber 49 and is opposed to the valve member 40, and an outer end of the inlet pipe 50 protrudes to the outside. An outlet end of the fourth inner pipe 28 is fitted into the outer end of the inlet pipe 50 with a spacer 51 interposed therebetween. The spacer 51** is formed into a ring-like configuration from a metal mesh.

The valve member 40 is turnable between a minimum flow rate position $P_1$ in which the volume of the inlet chamber 49 is minimum, as shown by a solid line in FIG. 8, and a maximum flow rate position $P_2$ in which the volume of the inlet chamber 49 is maximum, as shown by a dashed line in FIG. 8. The minimum flow rate position $P_1$ is defined by abutment of the valve member 40 against the opening at the inner end of the inlet pipe 50 to close the opening at the inner end of the inlet pipe 50, and the maximum flow rate position $P_2$ is defined by abutment of a stopper **40*a* connected to the valve member 40, against a side wall of the inner end of the inlet pipe 50**.

The exhaust gas pressure from the opening at the inner end of the inlet pipe 50 is applied to the valve member 40 in a direction to operate the valve member 40 to increase the volume of the inlet chamber 49. A recess **40*b* is provided in a central portion of the surface of the valve member 40 adjacent the inlet pipe 50 to receive the exhaust gas pressure. A reinforcing member 52 is mounted between a back of the recess 40*b* and the large-diameter shaft portion 39*a* of the rotary shaft 39**.

The valve housing 38 is provided with an outlet window 53 which directly communicates with the flow-in chamber 49, when the valve member 40 passes, as it moves toward the maximum flow rate position $P_2$, through a communication start point Pc (see FIG. 8) which is established within an operational range of the valve member 40 from the minimum flow rate position $P_1$ to the maximum flow rate position $P_2$. The area of the outlet window 53 facing the inlet chamber 49 is gradually increased as the valve member 40 is operated from the communication start point Pc toward the maximum flow rate position $P_2$.

In the course of operation of the valve member 40 from the minimum flow rate position $P_1$ to the maximum flow rate position $P_2$, the exhaust gas flowing from the inlet pipe 50 into the flow-in chamber 49 flows via a gap between the outer edge of the valve member 40 and the inner surface of the valve housing 38 into the outlet window 53 in a section from the minimum flow rate position $P_1$ to the communication start point Pc, while the exhaust gas flows from the flow-in chamber 49 directly into the outlet window 53 in a section from the communication start point Pc to the maximum flow rate position $P_2$.

A square flange **45*a* is integrally provided at the opened end of the case member 45 which is formed into the dish-like configuration opening toward the shell 12 and is connected to the housing half $38_1$. The shell 12 is provided with a bore which corresponds to the case member 45, and the flange 45*a* is located to abut against the inner surface of the shell 12 around the bore 54. Moreover, the flange 45*a* is provided with a plurality of four insertion bores 55, and nuts 56 coaxially connected to the insertion bores 55 and are secured to the opposite surface of the flange 45*a* from its surface abutting against the shell 12**.

A cover 57 covering the bore 54 is detachably secured to the shell 12 with a gasket 58 interposed between the cover 57 and the outer surface of the shell 12. More specifically, the cover 57 is detachably secured to the shell 12 by a plurality of bolts 59 threadedly inserted from the insertion bores 55 into the nuts 56 through the cover 57, the gasket 58 and the shell 12. Moreover, the cover 57 is formed into a cap-like configuration having an outwardly bulged sectional shape.

A spring chamber 60 is defined between the cover 57 and the case member 45. The spring chamber 60 is isolated from the insides of the shell 12 and the valve housing 38 and also isolated from the outside of the shell 12. The rotationally biasing spring 41 and the axially biasing spring 42 are positioned within the spring chamber 60.

More specifically, the small-diameter shaft portion **39*c* on the one end of the rotary shaft 39 which protrudes into the spring chamber 60, and the rotationally biasing spring 41 and the axially biasing spring 42 are disposed between a spring bearing member 61 secured to the end of the small-diameter shaft portion 39*c* and a dish-like lock member 62 which is welded to the inner end of the case member 45 within the spring chamber 60. The rotationally biasing spring 41 is a torsion spring spirally wound around the small-diameter shaft portion 39*c*, and has opposite ends engaged with the spring bearing member 61 and the lock member 62 to provide a spring force for rotationally biasing the valve member 40 toward the minimum flow rate position $P_1$. The axially biasing spring 42 is a coil spring surrounding the small-diameter shaft portion 39*c* and is mounted under compression between the spring bearing member 61 and the lock member 62 to provide a spring force for biasing the rotary shaft 39 in the one axial direction. Moreover, the rotationally biasing spring 41 is disposed to surround the axially biasing spring 42**.

The operation of this embodiment will be described below. The outlet window 53 is provided in the valve housing 38 of the flow rate regulating valve 30 disposed within the silencer 11, such that the area facing the flow-in chamber 49 is gradually increased as the valve member 40 is operated from the communication start point Pc established within the operational range of the valve member 40 toward the maximum flow rate position $P_2$. Therefore, during operation of the valve member 40 from the minimum flow rate position $P_1$ to the communication start point Pc, the flow resistance is determined by the gap which is defined between the outer edge of the valve member 40 and the inner surface of the valve housing 38 between the flow-in chamber 49 and the outlet window 53. During operation of the valve member 40 from the communication start point Pc to the maximum flow rate position $P_2$, the flow-in chamber 49 communicates directly with the outlet window 53, and the area of the outlet window 53 facing the flow-in chamber 49 is increased as the valve member 40 approaches the maximum flow rate position $P_2$. Therefore, while the valve member 40 is operated from the minimum flow rate position $P_1$ to the maximum flow rate position $P_2$, the flow resistance of the exhaust gas flow passage located between the fourth inner pipe 28 and the second silencing chamber 20 is decreased.

The flow resistance corresponding to the rotated position of the rotary shaft 39 and the operated position of the valve member 40 is determined by the position of the communication start point Pc at which the outlet window 53 starts to directly communicate with the flow-in chamber 49, and the area of the outlet window 53 facing the flow-in chamber 49 in a condition in which the outlet window 53 is in direct communication with the flow-in chamber 49. However, the communication start point Pc can be determined at any desired position within the operational range of the valve member 40, and the area of the outlet window 53 facing the flow-in chamber 49, i.e., the shape of the outlet window 53 can be determined as desired. Thus, the flow resistance, i.e., the flow rate corresponding to the rotated position of the rotary shaft 39, i.e., the operated position of the valve member 40 can be determined as desired.

In such a flow rate regulating valve 30, the rotary shaft 30 is biased in the direction to increase the flow resistance by the rotationally biasing spring 41, and also biased in the one axial direction by the axially biasing spring 42. Therefore, the abutment surface **39*b* provided on the rotary shaft 39 is urged against the limiting portion 46*a* provided on the valve housing 38, thereby avoiding the axial chattering of the rotary shaft 39** to prevent the generation of a noise due to the chattering.

Moreover, the rotationally biasing spring 41 is disposed around the rotary shaft 39 within the spring chamber 60 to surround the axially biasing spring 42, and in spite of the use of the two springs 41 and 42, the space for disposition of the springs 41 and 42 can be minimized. In addition, the spring chamber 60 is isolated from the inside of the shell 12 and the valve housing 38 and also from the outside of the shell 12. Thus, the springs 41 and 42 are not exposed to the outside of the shell 12 because they are within the spring chamber 60. Therefore, the springs 41 and 42 are not rusted, nor damaged by flying small stones or the like. Moreover, by the fact that the abutment surface **39*b* of the rotary shaft 39 is urged against the limiting portion 46*a* of the metal bearing 46, gas leaking out of the valve housing 38 into the spring chamber 60 is avoided. Even if the gas leaks into the spring chamber 60, the gas cannot leak to the outside of the shell 12 because the spring chamber 60 is isolated from the outside. In addition, the cover 57 is cooled by the open air, thereby avoiding the over-heating of the inside of the spring chamber 60** to prevent the springs from suffering a thermal damage. In particular, it is possible to increase the relative area cooled by the open air, thereby enhancing the cooling effect.

Further, since the cover 57 is detachably secured to the shell 12 so as to occlude the core 54 provided in the shell 12, it is possible to remove the cover 57 from the shell 12 for maintenance and inspection of the springs 41 and 42.

In an alternate arrangement, the spring chamber 60 may be defined between the shell 12 and the case member 57.

Although the embodiment of the present invention has been described in detail, it will be understood that the present invention is not limited to the above-described embodiment, and various modifications may be made without departing from the spirit and scope of the invention defined in the claims.

We claim:

1. An exhaust system in an internal combustion engine, said exhaust system comprising a gas flow passage having an intermediate portion, a flow rate regulating valve means which is positioned in said intermediate portion of said exhaust gas flow passage, said valve means having a valve housing and rotary shaft rotatably supported in said valve housing, a valve member secured to said rotary shaft, a rotationally biasing spring mounted between said rotary shaft and said valve housing, to provide a spring force for rotationally biasing said rotary shaft, and an axially biasing spring mounted separately from said rotationally biasing spring between said valve housing and said rotary shaft for biasing said rotary shaft in an axial direction, wherein said rotary shaft is provided with an abutment surface facing in the axial direction, and said valve housing is provided with a limiting portion which abuts against said abutment surface to limit the axial movement of said rotary shaft.

2. An exhaust system in an internal combustion engine according to claim 1, further including a spring bearing member fixed at one end of said rotary shaft, said rotationally biasing spring and said axially biasing spring being positioned between said spring bearing member and said valve housing, wherein one of said rotationally biasing spring and said axially biasing spring surrounds the other spring around said rotary shaft.

3. An exhaust system in an internal combustion engine, said exhaust system comprising an exhaust silencer having a first shell and a flow rate regulating valve means having a valve member and a valve housing, said valve member being operatively positioned within said valve housing positioned within said first shell of said silencer, spring means for biasing said valve member in a direction to increase a flow resistance, a case member and a second shell secured to said first shell, wherein a spring chamber is formed between said case member and said second sheel, said spring chamber being isolated from the inside of said first shell and said valve housing and also isolated from the outside of said first shell; and a rotationally biasing spring positioned in said spring chamber for biasing said valve member in a direction to increase the flow resistance.

4. An exhaust system in an internal combustion engine according to claim 3, wherein said first shell includes a bore therein, wherein said rotationally biasing spring can be inserted or removed therethrough, and wherein said second shell is detachably secured to said first shell and has an outwardly bulged sectional shape for covering said bore.

5. An exhaust system in an internal combustion engine, said exhaust system comprising a silencer having a shell; a plurality of silencing chambers formed in said shell and a pipe interconnecting two of said silencing chambers; and a flow rate regulating valve including a valve housing and a valve member operably positioned within said valve housing, said valve member being subjected to an exhaust gas pressure in a direction to decrease the flow resistance in said flow regulating valve, and being biased by a spring in a direction to increase the flow resistance, wherein the flow rate regulating valve is mounted to an outlet side of said pipe, and wherein said valve member forms a flow-in chamber between said valve member and said valve housing and has an outer edge which is in proximity to and opposed to an inner surface of said valve housing, said valve member being positioned within said valve housing for movement between a position to minimize a volume of said flow-in chamber and a position to maximize the volume of said flow-in chamber, said valve housing including an inlet pipe connected to said pipe and protruding into said flow-in chamber, said flow-in chamber having at an inner end thereof an opening which is opposed to said valve member, and an outlet window, wherein the area facing said flow-in chamber is increased as said valve member is operated from a communication start point established in an operational range of said valve member in a direction to increase the volume of said flow-in chamber.

* * * * *